US008512541B2

(12) United States Patent
Pearson

(10) Patent No.: US 8,512,541 B2
(45) Date of Patent: Aug. 20, 2013

(54) ELECTROLYTIC DISSOLUTION OF CHROMIUM FROM CHROMIUM ELECTRODES

(76) Inventor: Trevor Pearson, West Midlands (GB)

( * ) Notice: Subject to any disclaimer, the term of this patent is extended or adjusted under 35 U.S.C. 154(b) by 394 days.

(21) Appl. No.: 12/947,059

(22) Filed: Nov. 16, 2010

(65) Prior Publication Data

US 2012/0118749 A1 May 17, 2012

(51) Int. Cl.
*C25D 21/18* (2006.01)
*C25B 15/08* (2006.01)

(52) U.S. Cl.
USPC ..... 205/101; 204/233; 204/232

(58) Field of Classification Search
USPC ..... 205/101, 283–287, 243, 102, 103
See application file for complete search history.

(56) References Cited

U.S. PATENT DOCUMENTS

| | | | | |
|---|---|---|---|---|
| 3,111,464 | A * | 11/1963 | Safranek, Jr et al. | 205/101 |
| 4,278,512 | A | 7/1981 | Barclay et al. | |
| 4,374,007 | A | 2/1983 | Barclay et al. | |
| 5,082,538 | A * | 1/1992 | DeRespiris et al. | 205/140 |
| 5,269,905 | A | 12/1993 | Reynolds | |
| RE35,730 | E | 2/1998 | Reynolds | |
| 6,071,398 | A | 6/2000 | Martin et al. | |
| 6,207,033 | B1 | 3/2001 | Miller et al. | |
| 7,264,704 | B2 * | 9/2007 | Nevosi et al. | 205/101 |
| 7,780,840 | B2 | 8/2010 | Pearson et al. | |
| 2001/0054557 | A1 | 12/2001 | Taylor et al. | |
| 2003/0070934 | A1 * | 4/2003 | Cobley et al. | 205/263 |
| 2010/0006445 | A1 * | 1/2010 | Tomantschger | 205/96 |

FOREIGN PATENT DOCUMENTS

| | | |
|---|---|---|
| JP | 08-120500 | 5/1996 |

OTHER PUBLICATIONS

Translation of JP 08-120500 of Katagiri et al.*

* cited by examiner

*Primary Examiner* — Nicholas A Smith
*Assistant Examiner* — Brian W Cohen
(74) *Attorney, Agent, or Firm* — Carmody & Torrance LLP

(57) ABSTRACT

An electrolytic cell for replenishing chromium content of a trivalent chromium electrolyte and a method of replenishing trivalent chromium content using the electrolytic cell is provided. The method comprising the steps of immersing a chromium electrode and a second electrode in a trivalent chromium electrolyte and applying an alternating pulse current across the chromium electrode and the second electrode. In this manner, trivalent chromium is electrolytically dissolved from the chromium electrode and the trivalent chromium content of the electrolyte in which the chromium electrode is immersed is enriched.

20 Claims, No Drawings

ELECTROLYTIC DISSOLUTION OF CHROMIUM FROM CHROMIUM ELECTRODES

FIELD OF THE INVENTION

The present invention relates generally to the electrolytic dissolution of chromium from chromium electrodes as trivalent chromium.

BACKGROUND OF THE INVENTION

Chromium plating is an electrochemical process that is well-known in the art. There are two general types of chromium plating, hard chromium plating and decorative chromium plating. Hard chromium plating involves the application of a heavy coating of chromium onto steel substrates, typically to prevent wear, and exists in thicknesses in the range of about 10 to about 1000 μm. Decorative chromium plating applies a much thinner layer of chromium, in the range of about 0.25 to about 1.0 μm, and provides an extremely thin but hard coating for aesthetic purposes to achieve a shiny, reflective surface and/or protect against tarnish, corrosion and scratching of the metal beneath.

For decorative purposes, the chromium is generally applied over a coating of nickel. The chromium provides a hard, wear-resistant layer and excellent corrosion performance is obtained due to the chromium layer being cathodic with respect to the underlying nickel deposit. The underlying nickel layer becomes the anode in the corrosion cell and corrodes preferentially, leaving the chromium layer uncorroded.

Decorative chromium has traditionally been electroplated from electrolytes containing hexavalent chromium using, for example, an aqueous chromic acid bath prepared from chromic oxide ($CrO_3$) and sulfuric acid. However, many attempts have been made to develop a commercially acceptable process for electroplating chromium using electrolytes containing only trivalent chromium ions. The incentive to use electrolytes containing trivalent chromium salts arises because hexavalent chromium presents serious health and environmental hazards. Hexavalent chromium ion and its solutions have technical limitations including the ever-increasing cost of disposing of plating baths and rinse water. Furthermore, the operation of plating from baths containing substantially hexavalent chromium ion has operational limits which increase the probability of producing commercially unacceptable deposits.

For many years, chromium has been electro-deposited from electrolytes containing chromic acid using lead anodes. Lead anodes are commonly used because the cathodic efficiency of the process is quite low (usually no higher than 25%) so the use of soluble chromium anodes is not possible because it would cause a build-up of chromium metal in the plating bath. A secondary function of the lead anodes is to re-oxidize trivalent chromium produced in the plating bath at the cathode which is achieved via the formation of a lead dioxide coating at the surface of the anodes during electrolysis. In these baths, the chromium metal can simply be replaced by adding more chromic acid.

Because of the toxicity of chromic acid, chromium plating electrolytes based on trivalent chromium have more recently been developed. While these baths are safer to use than hexavalent baths, they rely on dragout of the plating solution in order to keep the solution in balance. Techniques such as drag-out recovery or partial "closed loop" techniques cannot be used with these processes because the source of chromium metal in the bath is a chromium salt (typically chromium sulfate). As the chromium is plated out of the bath, more chromium sulfate has to be added, resulting in a build-up of sulfate in the bath which can lead to problems if drag-out recovery or "closed loop" systems are employed.

Re. 35,730 to Reynolds, the subject matter of which is herein incorporated by reference in its entirety, describes a process and apparatus for regenerating a plating bath comprising trivalent chromium cations with an ion exchange resin, preferably a cation exchange resin to selectively remove impurities from the plating bath. The ion exchange column is connected to the plating tank. However, this system requires the use and disposal of ion exchange resins.

Therefore, it would be advantageous if the chromium metal in trivalent electroplating baths could be replenished by electrolytic dissolution of chromium metal in order to maintain the metal content of the bath. While this may appear to be a matter of simply applying an anodic potential to chromium metal anodes, in fact this is not possible in practice. The reason for this is that chromium is a very active metal that readily forms an oxide layer on its surface, which renders the chromium passive. Upon applying an anodic potential to this passive chromium, little dissolution of chromium occurs until the potential becomes sufficiently anodic as to exceed the trans-passive potential. At this point, the current increases and the chromium begins to dissolve. However, at the highly anodic potential required for this step, the chromium dissolves as hexavalent chromium, which is a severe poison for trivalent chromium electrolytes and will prevent the electrolyte from working. Consequently, there is no known method for dissolving chromium electrolytically continuously for a chromium metal electrode as trivalent chromium.

Passive chromium can be activated by making it cathodic and liberating hydrogen at the surface. Unfortunately, it re-passivates very quickly. Surprisingly, the inventors of the present invention have found that by applying an alternating series of cathodic and anodic current "pulses" to a chromium electrode that chromium dissolves readily from the chromium metal electrode in the form of trivalent chromium. The present invention has many potential applications for maintaining chromium metal content in processes containing trivalent chromium, including, for example, chromium plating and chromium passivation processes.

SUMMARY OF THE INVENTION

It is an object of the present invention to provide an improved means of replenishing trivalent chromium electrolytes.

It is another object of the present invention to electrolytically dissolve chromium from metallic chromium electrodes as trivalent chromium.

It is still another object of the present invention to use alternating pulse current to dissolve trivalent chromium from metallic chromium electrodes.

It is yet another object of the present invention to provide an improved method of manufacturing trivalent chromium salts from chromium metal.

It is still another object of the present invention to provide an improved electrolytic cell for the electrolytic dissolution of chromium using pulse reverse current.

To that end, in a preferred embodiment, the present invention relates generally to a method of replenishing chromium content of a trivalent chromium electrolyte, the method comprising the steps of:

a) immersing a chromium electrode and a second electrode in the chromium electrolyte; and b) applying an alternating pulse current across the chromium electrode and the second electrode;

wherein chromium is electrolytically dissolved from the chromium electrode and the chromium content of the electrolyte in Which the chromium electrode is immersed is enriched.

In another preferred embodiment, the present invention relates generally to an electrolytic cell for replenishing chromium content of a trivalent chromium electrolyte; the electrolytic cell comprising:

a) a chromium electrode and a second electrode immersable in a chromium electrolyte; and b) a pulse generating unit capable of supplying an alternating pulse current across the chromium electrode and the second electrode;

wherein when alternating pulse current is applied across the chromium electrode and the second electrode, chromium is electrolytically dissolved from the chromium electrode and the chromium content of the electrolyte in which the chromium electrode is immersed is enriched.

DETAILED DESCRIPTION OF THE PREFERRED EMBODIMENTS

The present invention relates to the electrolytic dissolution of chromium from a metallic chromium electrode as trivalent chromium. The process of the invention enables the replenishment of metal in chromium plating baths based on trivalent chromium. The method described herein may also be used in manufacturing chromium (III) salts from chromium metal.

The inventors of the present invention have found that by applying an alternating current of a suitable frequency, chromium can be dissolved from chromium metal electrodes as trivalent chromium. A pulsed periodic reverse current is created by alternating the current modulation between forward and reverse cycles. In one embodiment, this can be accomplished by inverting the current from cathodic to anodic mode, which disrupts the otherwise constant direct current polarization effects.

A pulse generating unit supplies the pulsed periodic reverse current which is applied across the two electrodes, and a suitable pulse generating system has the capability of generating forward and reverse currents of the same or, preferably, different magnitudes.

In one preferred embodiment, the present invention relates generally to a method of replenishing or increasing chromium content of a trivalent chromium electrolyte, the method comprising the steps of:

a) immersing an electrode comprising chromium and a second electrode in an electrolyte comprising trivalent chromium ions; and b) applying an alternating pulse current across the chromium electrode and the second electrode;

wherein chromium is electrolytically dissolved from the chromium electrode in the form of trivalent chromium ions and the trivalent chromium content of the electrolyte in which the chromium electrode is immersed is replenished or enriched.

Preferably, the chromium electrode comprises pieces of chromium metal in a titanium basket. Other arrangements of chromium electrodes would also be known to those skilled in the art and are usable in the present invention.

The duration of each forward pulse and each reverse pulse is typically between about 0.1 and about 2 seconds. In a preferred embodiment, the cycle time is between about 0.1 and about 2 seconds.

Various wave form shapes can be used in the practice of the invention and the shape of the wave form has not been found to be a critical factor in the dissolution of chromium from the chromium electrode(s). Each cycle of the waveform comprises a cathodic (forward) current pulse followed by an anodic (reverse) pulse and, optionally, a relaxation period. The sum of the cathodic on-time, anodic on-time and the relaxation time is the period of the pulse and the inverse of the period of the pulse is defined as the frequency of the pulsed current. The current density during the cathodic on-time and anodic on-time is known as the cathodic current density and the anodic current density respectively. The cathodic on-time, anodic on-time and relaxation time as well as the cathodic and anodic peak pulse current density are additional parameters available to control the electroplating process. In one preferred embodiment, there is a relaxation period after each reverse current pulse.

The frequency of the pulsed reverse current may be in the range of about 0.5 Hz to about 50 Hz. The duty cycle of the forward pulses may range from about 40% to about 60% and the duty cycle of the reverse pulses may range from about 40% to about 60%. It is preferred that the forward and reverse pulses alternate so that one reverse pulse is interposed between each pair of forward pulses and that the duty cycle of both anodic and cathodic pulses is preferably 50%.

The wave forms may be, for example, square, trapezoidal, sinusoidal, irregular or the like so long as they provide for a forward cathodic duty cycle and a reverse anodic duty cycle. An asymmetrical sine wave would also be a suitable wave form. The actual shape of the waveform used in a particular application will be determined by practical considerations of electrical current supply equipment.

Without wishing to be bound by theory, the inventors of the present invention believe that the following electrode reactions (1) and (2) are occurring:

(1) During the anodic phase of the cycle at the chromium electrode:

$$Cr \rightarrow Cr^{3+} + 3e^- \quad (1)$$

$$H_2 \rightarrow 2H^+ 2e^- \quad (2)$$

(2) During the cathodic phase of the cycle the following reactions (3) and (4) are occurring at the chromium electrode:

$$2H_2O + 2e^- \rightarrow H_2 + 2OH^- \quad (3)$$

$$2H^+ + 2e^- \rightarrow H_2 \quad (4)$$

Thus, hydrogen liberation is occurring during the cathodic phase along with dissolution of trivalent chromium and re-oxidation of hydrogen are occurring during the anodic phase. Surprisingly, the presence of adsorbed hydrogen appears to promote the dissolution of chromium as trivalent chromium, possibly by preventing "passivation" of the chromium electrode from occurring during the anodic phase.

By comparison, when the chromium is made the anode in a DC circuit, passivation occurs, which leads to the dissolution of chromium as hexavalent chromium as shown in the following equation (5):

$$2Cr + 7H_2O \rightarrow Cr_2O_7^{2-} + 14H^+ + 12e^- \quad (5)$$

A secondary reaction is the production of oxygen as shown in the following equation (6):

$$2H_2O \rightarrow O_2 + 4H^+ + 4e^- \quad (6)$$

In a preferred embodiment, the working plating bath can be circulated through an external cell wherein an alternating current is passed between either two chromium electrodes or, alternatively, between a chromium electrode and an insoluble electrode. In this instance, a portion of the electrolyte is removed from the chromium plating cell to the external cell and the electrodes are immersed in the removed portion. Once the removed portion of the electrolyte has been replenished with chromium to a desired concentration, it can be circulated back to the chromium plating bath.

The chromium electrolyte to be replenished typically comprises a sulfate salt and boric acid. Various sulfate salts can be used in the electrolyte and one preferred sulfate salt is potassium sulfate. In addition, the electrolyte is typically maintained at a temperature of between about 25 and about 40° C., preferably at about 30-35° C. The electrolyte is also at least substantially free of hexavalent chromium, meaning that no more than minute traces of hexavalent chromium should be present in the electrolyte composition.

In a preferred embodiment, the electrolyte is agitated or mixed while the electrodes are immersed therein.

The alternating pulse current is applied to the electrodes for a period time sufficient to replenish the chromium content of the electrolyte to a desired level, which may be for as little as 15 or 20 minutes and as long as a couple of hours. In a preferred embodiment, the alternating pulse current is applied to the electrodes continuously so that the plating bath is continuously replenished.

In a preferred embodiment, the insoluble electrode may comprise an iridium/tantalum oxide coated titanium electrode. Other insoluble electrodes that may he used in the practice of the invention include conductive materials selected from the group consisting of iridium/tantalum coated titanium, platinized titanium, carbon and other conductive materials that are substantially insoluble in the electrolyte, by way of example and not limitation.

As discussed above, in another preferred embodiment, two chromium electrodes are used. This doubles the rate of dissolution as current would not be wasted generating oxygen at the counter electrode.

In another preferred embodiment, the present invention relates generally to an electrolytic cell for replenishing chromium content of a trivalent chromium electrolyte; the electrolytic cell comprising:

a) an electrode comprising chromium and a second electrode immersed in an electrolyte comprising trivalent chromium ions; and b) a pulse generating unit capable of supplying an alternating pulse current across the chromium electrode and the second electrode;

wherein when alternating pulse current is applied across the chromium electrode and the second electrode, chromium is electrolytically dissolved from the chromium electrode in the form of trivalent chromium ions and the trivalent chromium ion content of the electrolyte in which the chromium electrode is immersed is replenished or enriched.

The electrolytic dissolution process for chromium and the electrolytic cell described herein also have application in the production of trivalent chromium salts or the replenishment of any processes containing trivalent chromium.

The invention will now he described with reference to the following non-limiting examples.

COMPARATIVE EXAMPLE 1

A chromium disc having a surface area of 10 $cm^2$ was suspended in 500 ml of a solution consisting of 150 g/l of potassium sulfate and 50 of boric acid. The solution was stirred at a temperature of 30° C. for 1 hour. The chromium disc was then removed and the solution was analyzed for chromium content. The chromium content of the solution was determined to be less than 2 ppm.

This example demonstrates that the rate of chromium dissolution by chemical means is very low.

COMPARATIVE EXAMPLE 2

A chromium disc having a surface area of 10 $cm^2$ was suspended in 500 ml of a solution consisting of 150 g/l of potassium sulfate and 50 g/l of boric acid. The solution was stirred and the chromium disc was made anodic using direct current at an average current density of 2 ASD for 1 hour at a temperature of 30° C. An iridium/tantalum oxide coated titanium electrode was used as the counter electrode. The chromium disc was then removed and the solution was analyzed. It was observed that the solution was yellow in color. A purple coloration was obtained with. acidified diphenylcarbazide solution indicating the presence of hexavalent chromium. Subsequent analysis revealed that substantially all of the chromium present in solution was present as hexavalent chromium, and the chromium content was determined to be 50 mg/l.

A calculation was performed based on Faraday's laws and the electrolytic dissolution efficiency was determined to be 8%. It is likely that the remainder of the current was utilized to produce oxygen.

EXAMPLE 1

A chromium disc having a surface area of 10 $cm^2$ was suspended in 500 ml of a solution consisting of 150 g/l of potassium sulfate and 50 g/l of boric acid. The solution was stirred and the chromium disc was electrolyzed using square wave alternating current (400 ms cathodic, 400 ms anodic) at an average pulse (anodic and cathodic) current density of 2 ASD for 1 hour at a temperature of 30° C. An iridium/tantalum. coated titanium electrode was used as the counter electrode. The chromium disc was then removed and the solution was analyzed. It was observed that the solution was blue/green in color. No purple color was obtained with acidified diphenylcarbazide solution, indicating the absence of hexavalent chromium, and the chromium concentration was determined to be 55 mg/l.

A calculation was performed based on Faraday's laws and the electrolytic dissolution efficiency was determined to be 42.3%. It is likely that the remainder of the current was utilized to oxidize hydrogen.

EXAMPLE 2

Two chromium discs, each having a surface area of 10 $cm^2$ was suspended in 500 ml of a solution consisting of 150 g/l of potassium sulfate and 50 g/l of boric acid. The solution was stirred and the chromium discs were electrolyzed using square wave alternating current (400 ms cathodic, 400 ms anodic) at an average pulse (anodic and cathodic) current density of 2 ASD for 1. hour at a temperature of 30° C. The chromium discs were then removed and the solution was analyzed. It was observed that the solution was blue/green in color. No purple coloration was obtained with acidified diphenylcarbazide solution, indicating the absence of hexavalent chromium. The chromium concentration was determined to be 115 mg/l.

A calculation was performed based on Faraday's laws and the electrolytic dissolution efficiency was determined to be 44.6%. It is likely that the remainder of the current was utilized to oxidize hydrogen, It can be seen from the results of Example 2 that the Faradaic yield of chromium ions was doubled by using chromium for both electrodes when an alternating current was applied.

It is also to be understood that the following claims are intended to cover all of the generic and specific features of the invention described herein and all statements of the scope of the invention which as a matter of language might fall therebetween.

What is claimed is:

1. A method of replenishing or increasing chromium content of a trivalent chromium electrolyte, the method comprising the steps of:

a) immersing an electrode comprising chromium and a second electrode in an electrolyte comprising trivalent chromium ions;

b) applying an alternating pulse current across the chromium electrode and the second electrode;

wherein chromium is electrolytically dissolved from the chromium electrode in the form of trivalent chromium ions and the trivalent chromium content of the electrolyte in which the chromium electrode is immersed is replenished or enriched the step of removing a portion of the chromium electrolyte to a separate cell prior to step a), wherein chromium content is enriched in the removed portion and;

thereafter returning the enriched chromium electrolyte to a chromium electroplating cell.

2. The method according to claim 1, wherein the second electrode comprises chromium.

3. The method according to claim 1, wherein the alternating pulse current comprises forward cathodic current pulses and reverse anodic current pulses.

4. The method according to claim 3, wherein the duration of each forward pulse and each reverse pulse is between about 0.1 and about 2 seconds.

5. The according to claim 3, comprising a relaxation period after each reverse current pulse.

6. The method according to claim 3, wherein the applied current density of the alternating pulses is between about 0.2 and about 10 ASD.

7. The method according to claim 1, wherein the chromium electrode comprises pieces of chromium metal in a titanium basket.

8. The method according to claim 2, wherein both chromium electrodes comprise pieces of chromium metal in a titanium basket.

9. The method according to claim 1, wherein the second electrode is a counter electrode comprising a conductive material that is substantially insoluble in the electrolyte.

10. The method according to claim 9, wherein the counter electrode comprises a conductive material selected from the group consisting of iridium/tantalum coated titanium, platinized titanium, carbon and other conductive materials that are substantially insoluble in the electrolyte.

11. The method according to claim 3, wherein hydrogen is formed during the cathodic forward pulse and chromium dissolves during the anodic reverse pulse.

12. The method according to claim 1, wherein the electrolytic dissolution efficiency is at least about 40%.

13. The method according to claim 12, wherein the electrolytic dissolution efficiency is at least about 45%.

14. The method according to claim 1, wherein the wave form of the alternating pulse current is selected from the group consisting of square, trapezoidal, sinusoidal, irregular, asymmetrical sine waves, and combinations of one or more of the foregoing.

15. The method according to claim 14, wherein the wave form is a square wave form and the duration of the alternating pulse current is about 400 ms forward cathodic pulse and 400 ms anodic reverse pulse.

16. The method according to claim 1, wherein the electrolyte is maintained at a temperature of between about 25 and about 40° C.

17. The method according to claim 1, wherein the electrolyte is at least substantially free of hexavalent chromium.

18. The method according to claim 1, wherein the electrolyte is agitated.

19. The method according to claim 1, wherein the alternating current is applied to the electrodes for a period time sufficient to replenish the chromium content of the electrolyte to a desired level.

20. The method according to claim 1, wherein the chromium electrolyte comprises a sulfate salt and boric acid.

* * * * *

UNITED STATES PATENT AND TRADEMARK OFFICE

CERTIFICATE OF CORRECTION

PATENT NO. : 8,512,541 B2
APPLICATION NO. : 12/947059
DATED : August 20, 2013
INVENTOR(S) : Trevor Pearson It is certified that error appears in the above-identified patent and that said Letters Patent is hereby corrected as shown below:

In the Claims:

Column 7, Line 23, in Claim 1:

After "or enriched" insert -- ; --

Signed and Sealed this
Eighth Day of October, 2013

Teresa Stanek Rea
*Deputy Director of the United States Patent and Trademark Office*